US006999689B2

(12) United States Patent
Kinoshita et al.

(10) Patent No.: US 6,999,689 B2
(45) Date of Patent: Feb. 14, 2006

(54) IMAGE FORMING APPARATUS AND METHOD OF CONTROLLING SAME

(75) Inventors: Masahide Kinoshita, Shizuoka (JP); Masao Uyama, Shizuoka (JP); Kenichi Iida, Boise, ID (US)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 10/898,961

(22) Filed: Jul. 27, 2004

(65) Prior Publication Data

US 2005/0063714 A1 Mar. 24, 2005

(30) Foreign Application Priority Data

Jul. 29, 2003 (JP) ..... 2003-203288
Jul. 22, 2004 (JP) ..... 2004-214852

(51) Int. Cl.
*G03G 15/00* (2006.01)
*G03G 15/08* (2006.01)

(52) U.S. Cl. ..... 399/27; 399/49; 399/30; 399/60; 399/61; 399/62

(58) Field of Classification Search ..... 222/DIG. 1; 399/27, 30, 58–64, 258, 260, 262, 263, 49
See application file for complete search history.

(56) References Cited

U.S. PATENT DOCUMENTS 6,381,419 B1 4/2002 Kinoshita et al. ..... 399/27
6,640,060 B2 10/2003 Yamaguchi et al. ..... 399/27
6,704,521 B2 3/2004 Isobe et al. ..... 399/12
6,771,911 B2 * 8/2004 Ko ..... 399/27
6,892,037 B2 * 5/2005 Ohkubo ..... 399/27
2003/0123889 A1 7/2003 Isobe et al. ..... 399/27
2003/0161643 A1 8/2003 Uyama et al. ..... 399/27

FOREIGN PATENT DOCUMENTS

JP 2-257167 10/1990
JP 8-185038 7/1996
JP 2002-116615 4/2002

* cited by examiner

*Primary Examiner*—Hoang Ngo
(74) *Attorney, Agent, or Firm*—Fitzpatrick, Cella, Harper & Scinto

(57) ABSTRACT

Provided are an image forming apparatus and method of controlling same in which when toner replenishment from a toner accommodating unit has been performed satisfactorily, a no-toner indication can be cancelled without taking more time than necessary, and in which the status of the toner accommodating unit can be reported to the user earlier even if a toner accommodating unit that has no toner or that has malfunctioned has been installed. Whether a toner accommodating unit (5) has toner is determined based upon a detection signal from a toner density sensor (46) that detects the toner density of a developer in a developing unit (4). If it is determined that there is no toner in the toner accommodating unit (5) and the toner accommodating unit (5) is replaced, this is detected and a toner density restoration sequence for restoring the density of toner in the developing unit (4) is executed. The toner density restoration sequence is controlled based upon a predetermined target value relating to toner density restoration and a toner density restoration decision value (V1) that is different from said predetermined target value.

14 Claims, 11 Drawing Sheets

IMAGE FORMING APPARATUS AND METHOD OF CONTROLLING SAME

FIELD OF THE INVENTION

This invention relates to an image forming apparatus such as a copier, printer, print-image display device and facsimile machine for developing and visualizing an electrostatic latent image formed on an image carrier by electrophotography or electrostatic printing, etc. More particularly, the invention relates to an image forming apparatus having a developer density control unit for controlling the toner density of a two-component developer.

BACKGROUND OF THE INVENTION

A developing device for developing electrostatic latent images on an image carrier by using a two-component developer that includes a toner and a carrier is known in the art.

As is well known, the toner density of a two-component developer, namely the ratio of toner weight to the total weight of carrier and toner, is extremely important in terms of stabilizing image quality. The toner density of a two-component developer changes as the toner is consumed during development. In order to deal with this, the specification of Japanese Patent Application Laid-Open No. 2002-116615 discloses detecting the toner density of developer in a developing device at suitable times using a developer density controller (ATR, or Automatic Toner Replenisher) and holding the toner density constant by replenishing the developing device with toner in accordance with a change in the toner density, thereby maintaining the quality of the image.

Various schemes have been put to practical use in the toner density sensing means and density controller for the developer in the developing device.

For example, a developer density control apparatus known in the art has optical-type density sensing means disposed in close proximity to a developing sleeve or developer transport path within a developing device, causes light to strike developer carried on and transported by the developing sleeve, which serves as a developer carrier, or developer contained in a developer vessel, senses the toner density of the developer by utilizing the fact that the reflectivity of the light reflected from the toner differs depending upon the toner density, and controls the toner density accordingly. Alternatively, use is made of an inductance-sensing-type developer density control apparatus (inductance ATR) that has an inductance head, which senses apparent magnetic permeability based upon the mixing ratio of magnetic carrier and non-magnetic toner, disposed on the side wall of a developing device, senses the toner density of the developer based upon a change in magnetic permeability, and replenishes toner based upon a comparison between the sensed toner density and a reference value.

In another method available in the art, a patch image for sensing density is formed on a photosensitive drum serving as an image carrier, the density of the patch is sensed by an optical sensor provided at a position opposing the surface of a photosensitive drum, the analog output obtained is converted to a digital signal and the digital signal is sent to a CPU. If the sensed density is greater than an initially set value, the CPU halts the replenishment of toner until the sensed density returns to the initially set value. If the sensed density is less than the initially set value, then the CPU replenishes the developing device with toner until the initially set value is restored, thereby regulating the toner density of the developer to a desired value.

In accordance with the density control method used in the inductance ATR, assume by way of example that the apparent magnetic permeability is sensed to be high. This means that the proportion of carrier contained in developer of fixed volume is large and that the toner density of the developer is low. In such case, therefore, the developing device starts being replenished with toner. Conversely, if the apparent magnetic permeability of the developer is low, this means that the proportion of carrier contained in developer of fixed volume is small and that the toner density of the developer is high. Accordingly, the developing device stops being replenished with toner. The toner density of the developer is thus controlled.

FIG. 1 is a sectional view illustrating a two-component developing device that employs such an inductance ATR. As shown in FIG. 1, a developing device 50 has a developing vessel 51 containing a developer. A hollow metal sleeve (developing sleeve) 52 serving as a developer carrier is freely rotatably disposed in an opening of the developing vessel 51 in close proximity to a photosensitive drum 1. A magnet roller 53 of magnetic-field generating means is disposed non-rotatably within the developing sleeve 52. A blade 54 for regulating the thickness of a toner layer is provided below the developing sleeve 52 in close proximity to the sleeve. Developer transported with rotation of the developing sleeve 52 in the direction of the arrow has its layer thickness reduced by the blade 54.

Placed inside the developing vessel 51 substantially in parallel with the developing sleeve 52 are a first screw (A screw) 55 and a second screw (B screw) 56 on the side of a partitioning wall 57 opposite the A screw 55. The A and B screws 55 and 56 rotate in the directions of the arrows and serve to stir and transport the developer in mutually opposing directions along the longitudinal direction of the screws. The partitioning wall 57 is not connected to the wall of the developing vessel 51 at both ends along the longitudinal direction, and openings therefore are defined between the partitioning wall 57 and the wall of the vessel. Developer that has been transported by the A screw 55 is delivered to the side of the B screw 56 through one of the openings in the partitioning wall 57, and developer that has been transported by the B screw 56 is delivered to the side of the A screw 55 through the other opening in the partitioning wall 57. As a result, the developer is made to circulate between the A and B screws 55 and 56, respectively.

Developer that has been used in development on the side of the A screw 55 is sent to the side of the B screw 56 and the toner density is sensed by a toner density sensor 58 situated upstream of the B screw 56 in terms of the direction of developer transport. A suitable amount of toner is supplied from a toner accommodating unit 60 through a replenishing cylinder 59 downstream of the toner density sensor 58 in such a manner that the output value of the toner density sensor 58 will become a value (referred to as a "target value" below) corresponding to a desired toner density.

The toner accommodating unit 60 is removably mounted on the main body of an image forming apparatus. FIG. 2 illustrates the structure of the toner accommodating unit 60. A toner replenishing port 61 is connected to the replenishing cylinder 59 from which the toner is supplied by rotation of a toner replenishing screw 62. In a case where it has been determined from the result of detection by the toner density sensor 58 that the toner density is low, a signal is sent to the CPU of the image forming apparatus in such a manner that additional toner is supplied. Upon receiving this signal, the CPU performs a replenishing operation by rotating a drive motor that drives the toner replenishing screw 62. Since the relationship between the rotational speed of the screw and the amount of toner replenishment is known in advance, the rotational speed of the toner replenishing screw 62 is decided based upon the result from the toner density sensor 58, a desired amount of toner is supplied and the toner density of the developer is held constant at all times.

Absence of toner in the toner accommodating unit 60 of the developing device 50 is sensed in the manner described below. FIG. 3 illustrates a change in the output value of the toner density sensor 58.

First, when toner is consumed, the ratio of carrier increases and therefore the output value of the toner density sensor 58 rises. Toner replenishment from the toner accommodating unit 60 is controlled in such a manner that the output value will become the target values, as described above. Of course, if there is toner inside the toner accommodating unit 60, then the output value of the toner density sensor 58 will approximately agree with the target value (the "toner-present state" in FIG. 3).

If toner runs out with use of the toner accommodating unit 60, the printing operation continues, toner is consumed and replenishment of toner ceases. As a result, the output value of the toner density sensor 58 gradually rises (the "no-toner state" in FIG. 3).

If a no-toner decision value is determined and the output value of the toner density sensor 58 attains this decision value, absence of toner is finally determined (the "final no-toner point" in FIG. 3) and the user is so informed as by presenting a display on the panel of a printer.

If the user has been notified of absence of toner, the toner accommodating unit is exchanged for a new one. A toner density restoration sequence usually is provided for the purpose of raising the density of toner in the developing device 50 so as to obtain a desired image at the time of the exchange, and for the purpose of checking that toner is contained in the replaced toner accommodating unit.

In the toner density restoration sequence, replenishment of toner is carried out in such a manner that the density of toner in the developing device 50 will become the desired toner density, i.e., in such a manner that the output value of the toner density sensor 58 will become the target value. When the output value of the toner density sensor 58 falls below the target value, the display indicating absence of toner is cancelled.

By exercising control in this fashion, the user is notified of the fact that the developing device 50 is in a usable state. In addition, it is possible to inform the user of the fact that the toner accommodating unit is normal.

Further, if the user has inserted a toner accommodating unit that is in the no-toner state or in a state in which a malfunction has occurred and toner cannot be supplied, toner density will not be restored. It is so arranged, therefore, that notification of absence of toner will not be cancelled in this case. Here an upper limit is decided for the time of the toner density restoration sequence, whereby the state of the toner accommodating unit can be judged after a prescribed length of time. This makes it possible to notify the user of the fact that the toner accommodating unit has no toner or of the fact that a malfunction has occurred.

However, if a user installs a new toner accommodating unit in an image forming apparatus and the toner density restoration sequence begins, the following problem arises with the above-described control method.

Specifically, regardless of the fact that a normal toner accommodating unit has been installed, there are instances where toner density does not manage to recover and the toner density restoration sequence continues for a long period of time.

This problem arises in the case of a so-called "packed state", namely a state in which toner bulk diminishes and density rises when a toner accommodating unit has been left standing for a long period of time. If the packed state occurs, the toner will not be readily transported, even though the toner replenishing screw rotates, and the toner will not readily drop from the replenishing port. The toner will have even more difficulty dropping if the user has left the toner accommodating unit standing with its replenishing port facing upward. In other words, in a case where the user has extracted a toner accommodating unit and left it standing with the replenishing port facing upward, the toner replenishing screw will be at the top owing to the fact that the replenishing port is facing upward and therefore toner will not be present in the vicinity of the toner replenishing screw. In some cases the toner within the vessel will solidify. If this occurs, the desired amount of toner for replenishment will not be supplied even though the toner accommodating unit has been installed in the image forming apparatus and the toner replenishing screw is rotated.

Thus, in a case where a normal toner accommodating unit containing toner has been installed, it is necessary to raise the upper-limit time of the toner restoration sequence in such a manner that an erroneous decision to the effect that the toner accommodating unit is devoid of toner will not be rendered.

Since the upper-limit time of the toner restoration sequence is raised in this fashion, the time it takes to determine that a toner accommodating unit is devoid of toner will be longer than necessary in a case where this toner accommodating unit devoid of toner has been installed accidentally by the user. This is undesirable.

SUMMARY OF THE INVENTION

Accordingly, the present invention is provided to improve upon the conventional image forming apparatus.

Further, the present invention provides an image forming apparatus in which it is possible to prevent an excessive period of time for judging the state of a toner accommodating unit newly installed in exchange for an old toner accommodating unit, thereby enabling the state of the toner accommodating unit to be determined earlier so that the user will not be inconvenienced.

Moreover, the present invention provides an image forming apparatus in which the electric charge on replenished toner when a toner accommodating unit is exchanged can be prevented from becoming unstable, and in which it is possible to prevent a change in image density and the occurrence of fogging at the time of a subsequent printing operation.

According to one aspect of the present invention, preferably, an image forming apparatus in which a toner accommodating unit for accommodating toner is removably installed, comprises: a developing unit for developing a latent image on an image carrier using a developer that includes toner and carrier; a toner density sensor for sensing toner density of the developer in the developing unit; and a controller for detecting replacement of the toner accommodating unit and executing a toner density restoration sequence for restoring toner density in the developing unit if it has been determined that there is no toner in the toner accommodating unit based upon a detection value from the toner density sensor; wherein the controller controls operation of the toner density restoration sequence based upon a predetermined target value relating to toner density restoration and a toner density restoration decision value that is different from the predetermined target value.

According to another aspect of the present invention, preferably, a method of controlling an image forming apparatus in which a toner accommodating unit for accommodating toner is removably installed, comprises: a toner density detecting step of detecting toner density of a developer in a developing unit that develops a latent image on an image carrier using the developer, which includes toner and carrier; a determination step of determining whether the toner accommodating unit has toner based upon a detection value from the toner density detecting step; a sequence execution step of detecting replacement of the toner accommodating unit and executing a toner density restoration sequence for restoring toner density in the developing unit if it has been determined at the determination step that there is no toner in the toner accommodating unit; and a control step of controlling operation of the toner density restoration sequence based upon a predetermined target value relating to toner density restoration and a toner density restoration decision value that is different from the predetermined target value.

According to further aspect of the present invention, preferably, an image forming apparatus in which a toner accommodating unit for accommodating toner is removably installed, comprises: a developing unit for performing image formation; a density sensor for sensing density of toner in the developing unit; and a controller for executing an operation for replenishing toner from the toner accommodating unit based upon an output value from the density sensor and a predetermined density reference value; wherein if the toner accommodating unit has been replaced, the controller executes an operation for changing over the predetermined density reference value and replenishing the developing unit with toner.

According to yet further aspect of the present invention, a method of controlling an image forming apparatus in which a toner accommodating unit for accommodating toner is removably installed, comprises: a sensing step of sensing density of toner in a developing unit for performing image formation; and a toner replenishing step of replenishing toner from the toner accommodating unit based upon a sensed toner density value and a predetermined density reference value; and a toner density restoration step of executing an operation for changing over the predetermined density reference value and replenishing the developing unit with toner if the toner accommodating unit has been replaced.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention, in which.

DETAILED DESCRIPTION OF THE PREFERRED EMBODIMENTS

Preferred embodiments of the present invention will be described in detail in accordance with the accompanying drawings.

<First Embodiment>

Figure 1:
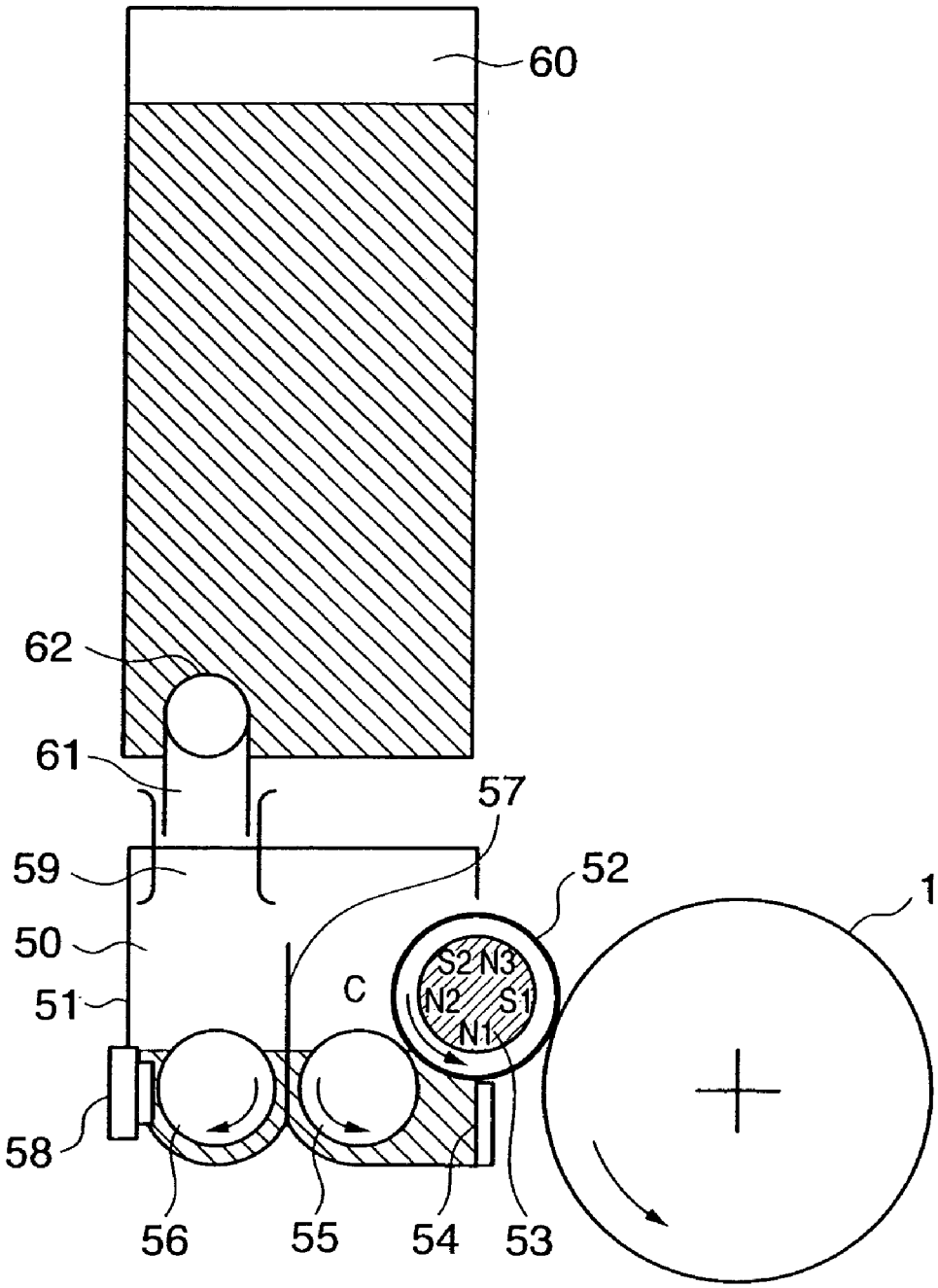
FIG. 1 is a sectional view illustrating the general features of a developing device according to the prior art.
Figure 2:
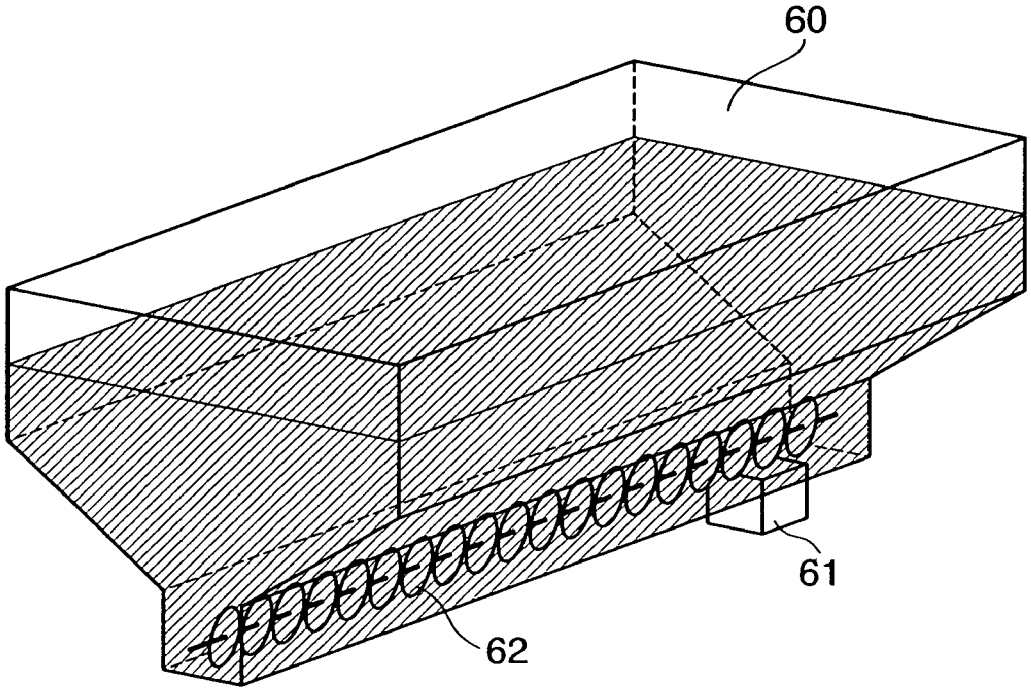
FIG. 2 is a perspective view of a toner accommodating unit according to the prior art.
Figure 3:
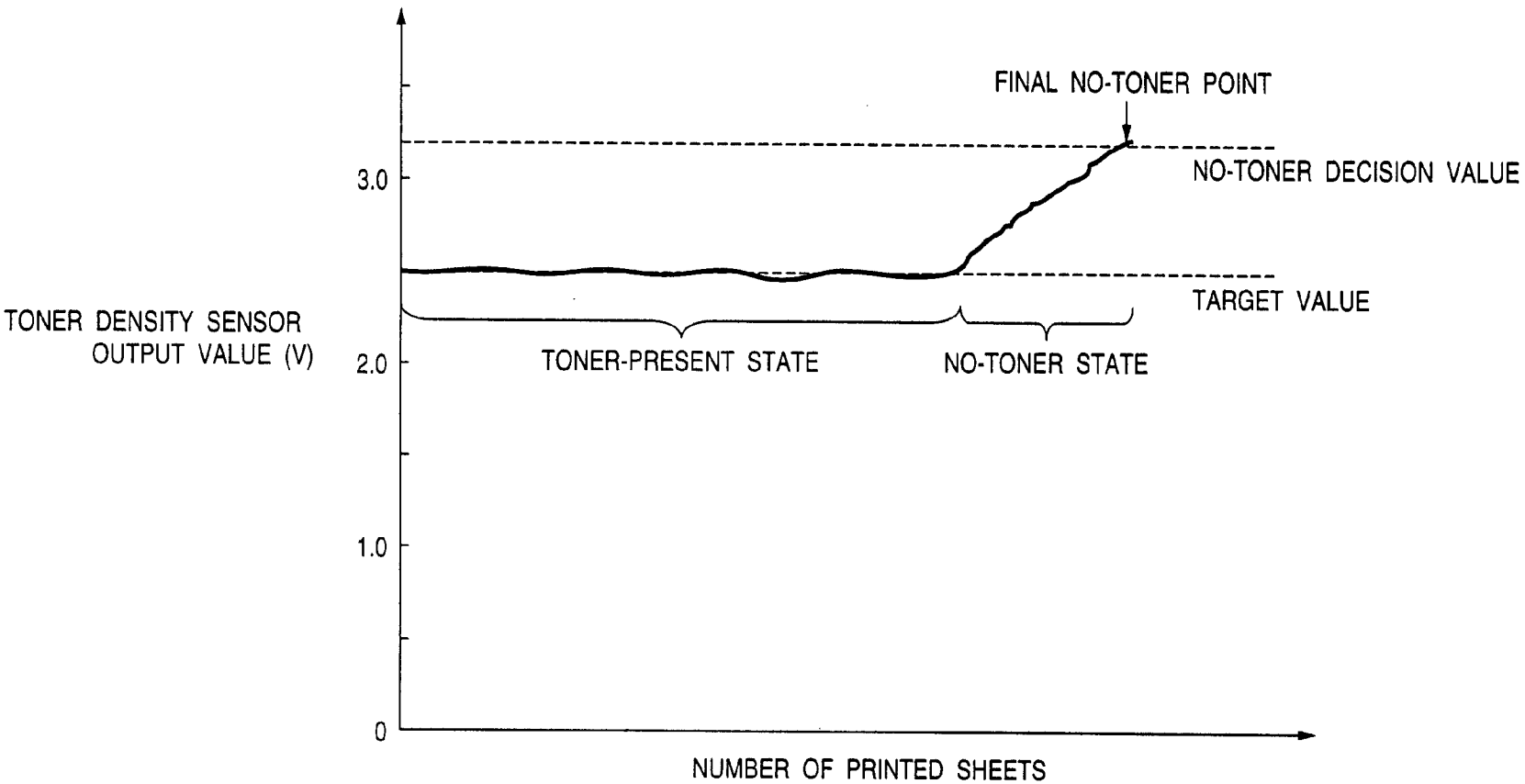
FIG. 3 is a diagram illustrating the transition of the output value of a toner density sensor according to the prior art.
Figure 4:
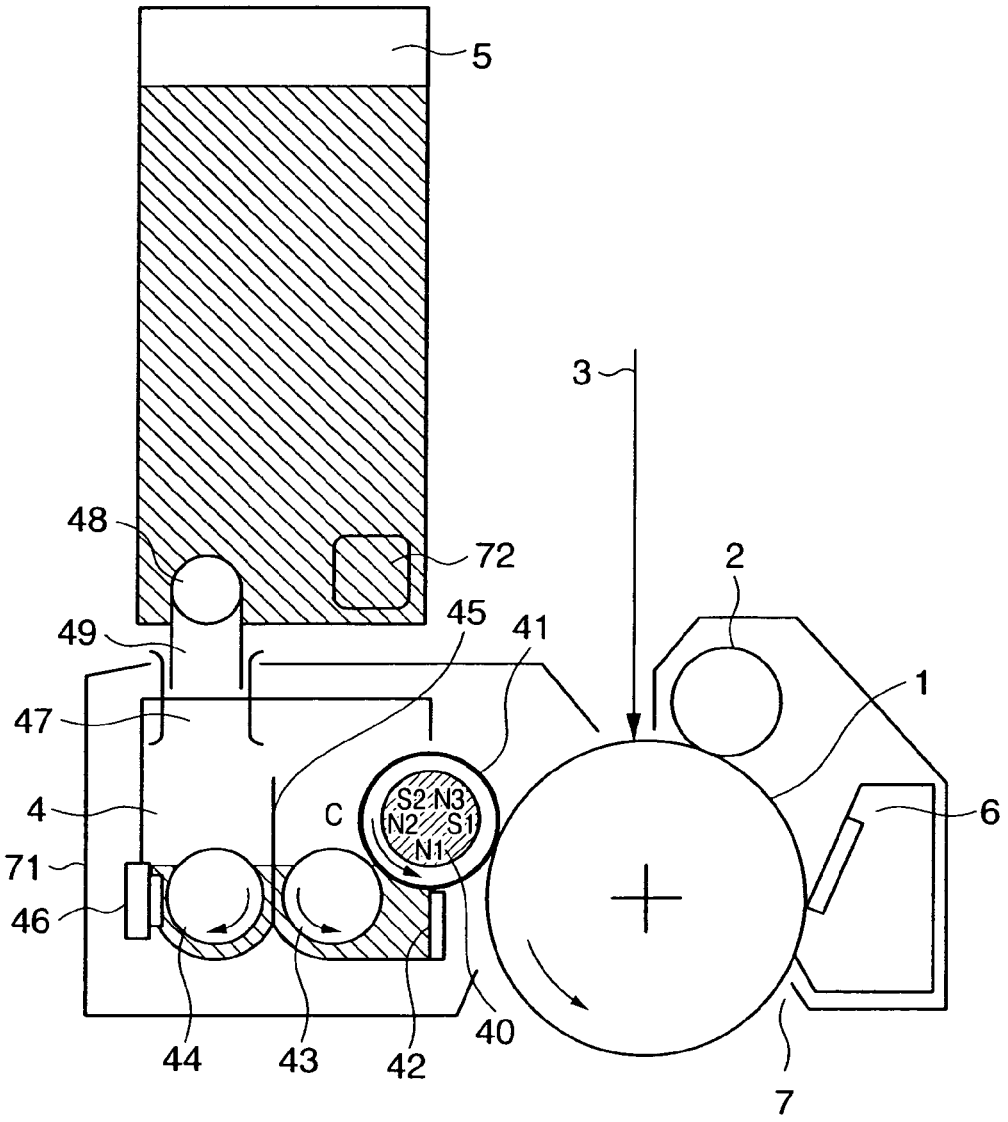
FIG. 4 is a sectional view illustrating the general features of a process cartridge and toner accommodating unit according to the present invention.

FIG. 4 is a schematic sectional view of a process cartridge 7 that utilizes an electrophotographic process. The process cartridge 7 includes a photosensitive drum 1, a developing device 4, a charging roller 2 and a cleaner 6. These components are formed into a unit by a cover 71 serving as a covering frame.

Figure 5:
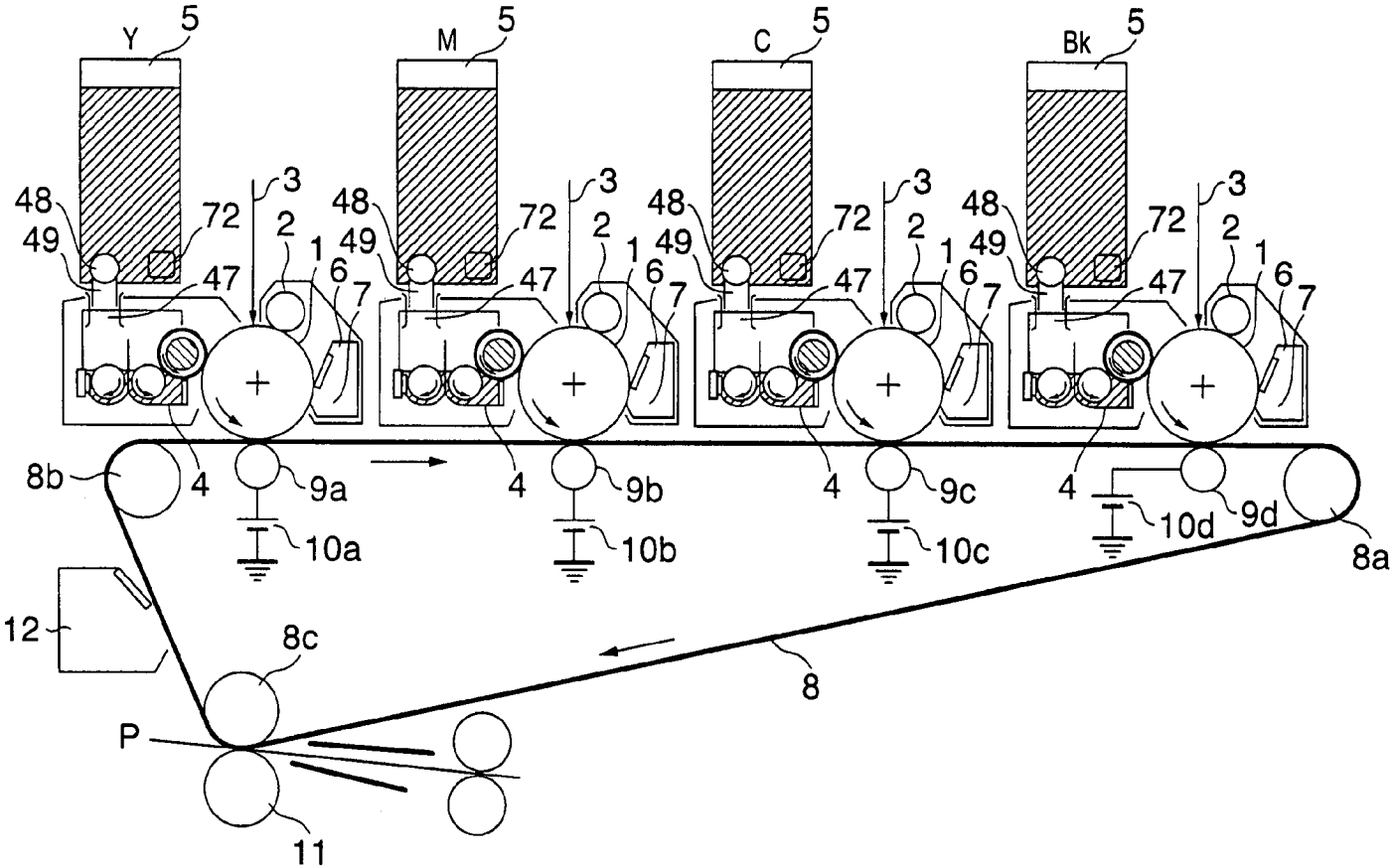
FIG. 5 is a sectional view illustrating the general features of an image forming apparatus according to the present invention.

FIG. 5 is a schematic sectional view illustrating a color laser printer. The color laser printer is a four-drum (in-line) printer, which has a plurality of process cartridges 7, for obtaining a full-color print image by temporarily transferring images continuously to an intermediate transfer belt 8 serving as a second image carrier.

The endless intermediate transfer belt 8 in FIG. 5 spans a driver roller 8*a*, a tension roller 8*b* and secondary opposing rollers 8*c* and circulates in the direction indicated by the arrows.

The process cartridge 7 will now be described.

The photosensitive drum 1 disposed in the process cartridge 7 for developing yellow toner is charged uniformly to a prescribed polarity and potential by a primary charging roller 2 during the coarse of rotation of the drum. Next, the photosensitive drum 1 receives image exposing light 3 produced by image exposing means (an optical system for separating the image of a color original into colors and for applying exposure to form an image, and a scanning optical system using laser scanning to output a laser beam modulated in accordance with a time-series digital pixel signal representing image information), not shown, whereby an electrostatic latent image corresponding to a first color-component image (the yellow-component image) of the desired color image is formed on the drum.

Next, the electrostatic latent image is developed by yellow toner, which is a first color, using a first developing device 4 (yellow developing device).

Figure 6:
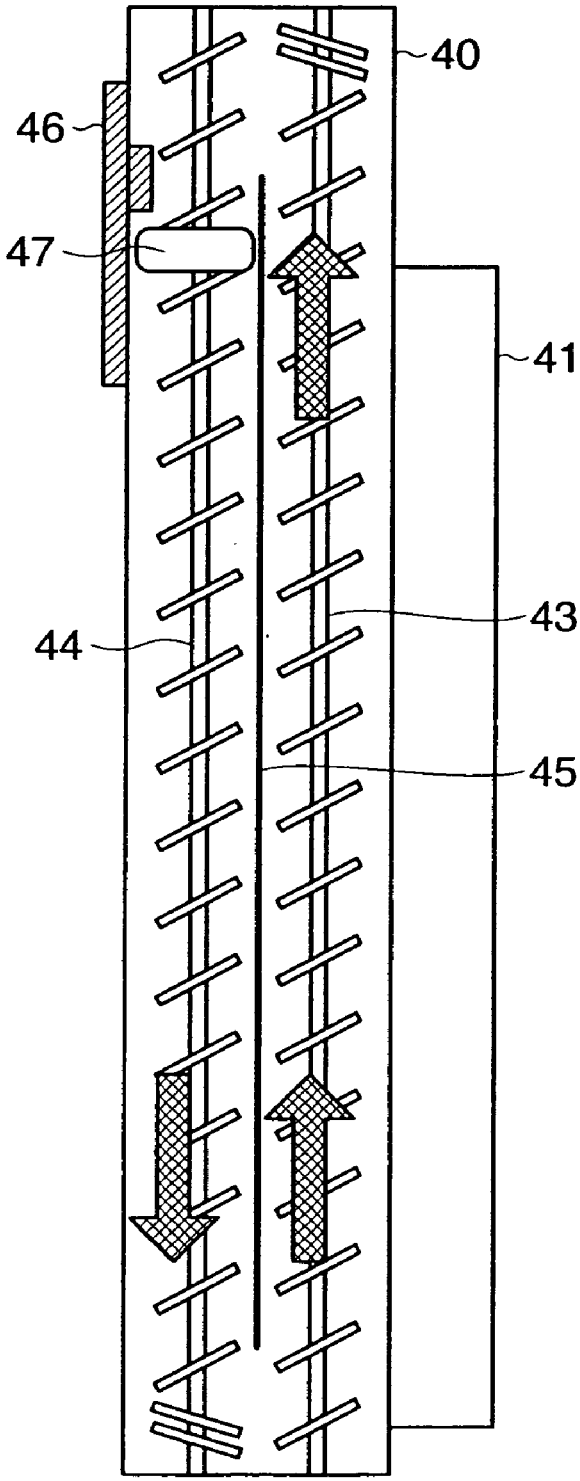
FIG. 6 is a diagram illustrating a developing device of the present invention as seen from above.

The developing device 4 will be described with reference to FIGS. 4 and 6.

The developing device 4 is a two-component contact-type developing device (two-component magnetic-brush developing device) in which a developer comprising carrier and toner is held on a developing sleeve 41 containing a magnet roller 40. The developing sleeve 41 is provided with a developer limiting blade 42 spaced a prescribed distance away from the sleeve. As the developing sleeve 41 rotates in the direction of arrow C, a thin layer of developer is formed on the developing sleeve 41.

The developing sleeve 41 is disposed so as to define a prescribed gap between itself and the photosensitive drum 1 and is set in such a manner that the thin layer of the developer formed on the developing sleeve 41 can be developed in a state in which it contacts the photosensitive drum 1. The toner used in this embodiment is negatively charged toner having a mean particle diameter of 6 $\mu$m, and the carrier is a magnetic carrier having a mean particle diameter of 35 $\mu$m and a saturation magnetization of 205 emu/cm$^3$. Further, a mixture of toner and carrier having a toner to carrier weight ratio of 8:92 (the toner density in the developer is 8%) is used as the developer.

Stirring screws 43, 44 for stirring the developer are provided in the developing device 4, rotate in sync with the sleeve and function to stir replenished toner and carrier and apply prescribed tribo-electrification to the toner. FIG. 6 is a diagram illustrating the developing device 4 as seen from above. This shows the circulating state of the developer and the placement along the longitudinal direction. As the screws 43, 44 rotate, the developer is circulated in the direction of the arrows in the vicinity of a partitioning wall 45.

A so-called inductance-type toner density sensor 46 for detecting a change in magnetic permeability of the developer to thereby sense the density of toner in the developer is provided on the side wall of the developing device 4 upstream of the screw 44 in terms of the developer transport direction. A toner replenishing port 47 is provided somewhat downstream of the sensor 46.

After the developing operation is performed, developer is carried to the toner density sensor 46, which proceeds to sense the toner density. In order for the density of the toner in the developer to be held constant in accordance with the result of sensing toner density, toner replenishment is performed appropriately from a toner accommodating unit 5 through the toner replenishing port 47.

A control voltage is impressed upon the toner density sensor 46 of this embodiment in such a manner that an output of 2.5 V will be obtained when the toner density is the suitable value of 8%. Toner replenishment control is carried out using the value of 2.5 V as a target output voltage Vt in such a manner that the output value of the toner density sensor 46 will become the value of 2.5 V.

The additionally supplied toner is transported by the screw 44 in the direction of the arrow, mixed with the carrier and carried to the vicinity of the sleeve 41 upon being furnished with a prescribed tribo-electrification. A thin layer is formed on the developing sleeve 41 and is used in development.

In FIG. 5, the yellow image formed on the photosensitive drum 1 advances to a primary transfer nip between the drum 1 and the intermediate transfer belt 8. Primary transfer rollers 9*a* to 9*d* are rotated while contacted with the underside of the intermediate transfer belt 8 at the transfer nips. The primary transfer rollers 9*a* to 9*d* have primary transfer biasing sources 10*a* to 10*d*, respectively, in order to enable the application of bias independently at each port. The intermediate transfer belt 8 first transfers yellow at the port of the first color, then, through a process similar to that just described, transfers the colors magenta, cyan and black successively at each of the ports from the photosensitive drums 1 corresponding to respective ones of the colors Toner remaining on the photosensitive drum 1 after the primary transfer is carried to the cleaner 6 as the photosensitive drum 1 rotates and is cleaned off the drum by the cleaner, thereby preparing for the next image forming step. Meanwhile, the four-color full-color images that have been formed on the intermediate transfer belt 8 are transferred collectively to a transfer medium P by a secondary transfer roller 11, and the images are fused and fixed by a fixing unit (not shown) to obtain a color print image.

Residual toner from the secondary transfer remaining on the intermediate transfer belt 8 is cleaned off by a blade of a cleaner 12 for the intermediate transfer belt, thereby preparing for the next step. In order to improve registration at the port of each color, the material selected for the intermediate transfer belt 8 should not be one that stretches and contracts. Preferably, the belt 8 is made of a resin material or is a rubber belt containing a metal core or a combination of a rubber belt and resin. In this embodiment, use is made of a resin belt in which carbon is dispersed in PI (polyimide) and the volume resistance is regulated to a value on the order of $10^8$ Ω. The belt has a thickness of 80 $\mu$m, a length of 320 mm in the longitudinal direction and an overall length of 900 mm. Further, an expanded foam of medium resistance is used as the primary transfer rollers 9*a* to 9*d*. More specifically, the resistance of the foam is $10^6$ Ω.

The image forming conditions will now be described in simple terms.

On the photosensitive drum:

Dark potential (potential of non-image areas produced by primary charging): Vd=−600 V Bright potential (potential of image areas produced by laser exposure): Vl=−150 V Developing bias: Vdc=−400 V Vac=1800 Vpp Frequency=2300 Hz Process speed: 117 mm/s Primary transfer bias: +400 V from first to fourth colors The plain-paper throughput of the above-described printer is 24 ppm when feeding letter (LTR) size width (216 mm), and the image intervals (sheet spacing) is 80 mm.

Further, the toner accommodating unit 5 and process cartridge 7 are inserted and installed in prescribed locations of the color laser printer through a prescribed procedure by installing means (not shown) and can be withdrawn from the apparatus by reversing the procedure.

Figure 7:
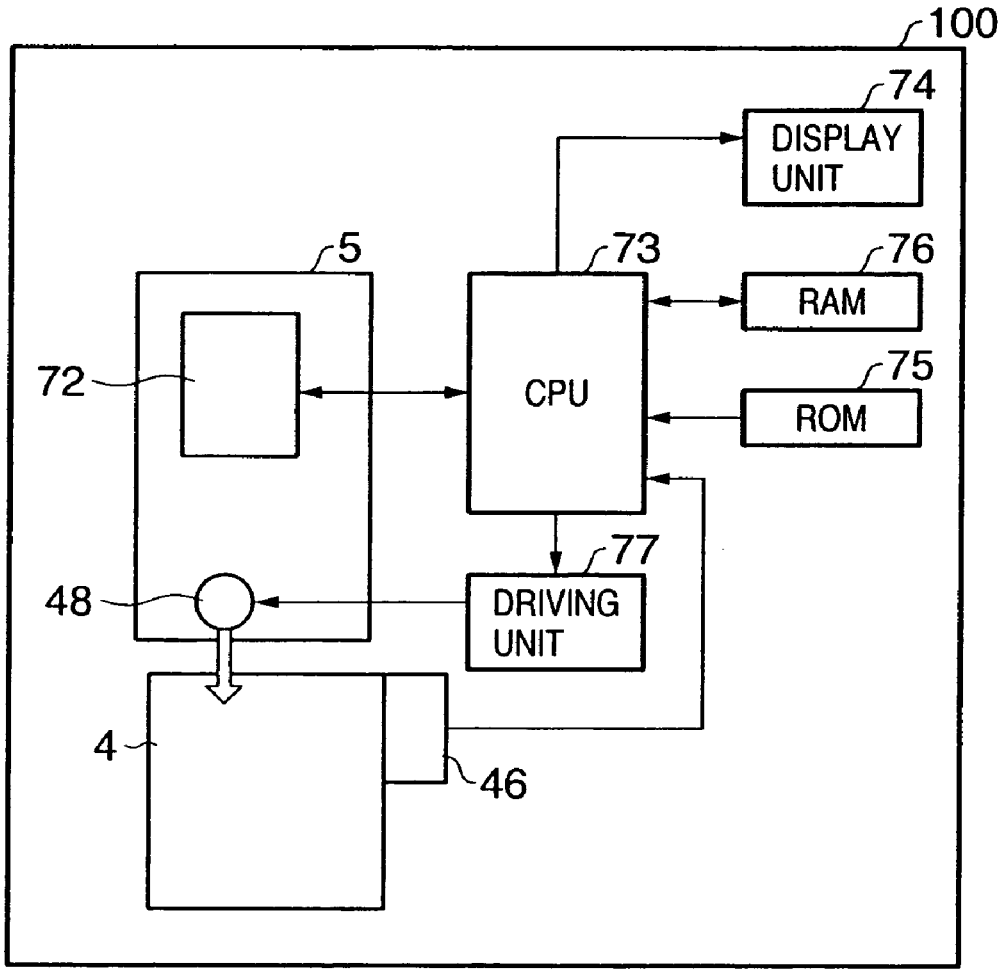
FIG. 7 is a block diagram illustrating the main functions of the image forming apparatus according to the present invention.

FIG. 7 is a block diagram illustrating the overall mechanism of an image forming apparatus (printer) 100 to which this embodiment is applied. Besides the blocks shown in FIG. 7, there are functional blocks that are necessary to implement the image forming apparatus. However, since these blocks have little direct bearing upon the features of the embodiment, they are neither illustrated nor described.

The image forming apparatus 100 in FIG. 7 includes a CPU 73 for controlling the overall apparatus, a display unit 74 for displaying results of prescribed control as well as detected apparatus anomalies and warning messages, a ROM 75 storing a program for executing the processing of a flowchart described later, a RAM 76 that operates as a work area for temporarily storing this program in order to execute the same and used also to store other programs, a driving unit 77 for driving a toner replenishing screw 48, the developing device 4, the toner accommodating unit 5, the toner density sensor 46, the toner replenishing screw 48 and memory means 72 provided in the toner accommodating unit 5.

The toner density sensor 46 in FIG. 7 detects the toner density in the developing device 4, as described above, and outputs this value. The CPU 73 determines whether toner replenishment is necessary based upon the output value from the toner density sensor 46. If replenishment is necessary, then the CPU 73 outputs a drive signal to the driving unit (motor) 77 to control toner replenishment. Upon receiving the drive signal from the CPU 73, the driving unit 77 uses this signal as a trigger and drives the toner replenishing screw 48, thereby replenishing the developing device 4 with toner.

Figure 9:
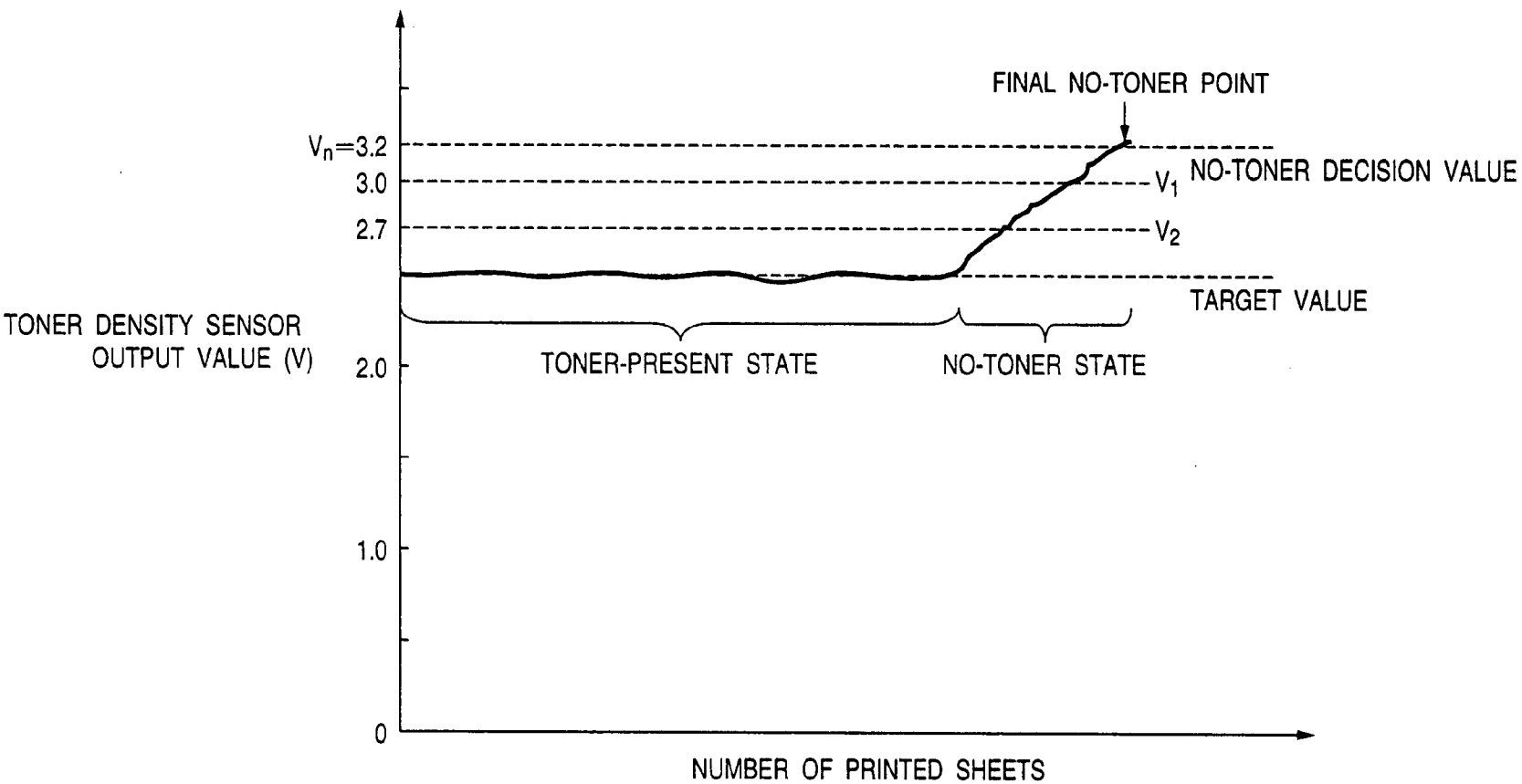
FIG. 9 is a diagram illustrating the transition of the output value of a toner density sensor according to the present invention.

Further, in a case where absence of toner in the toner accommodating unit 5 is detected according to the output value of the toner density sensor 46 (i.e., in a case where the start of a rise in the output voltage is detected in FIG. 9), a signal indicating absence of toner is output to and displayed on the display unit 74. If the CPU 73 thenceforth detects the toner accommodating unit 5 has been replaced by the user, then control is exercised so as to start the toner density restoration sequence in the developing device 4. It should be noted that replacement of the toner accommodating unit 5 is detected by sensing opening and closing of a door or by establishment of communication with the memory means 72, by way of example.

A mechanism for sensing amount of remaining toner in the toner accommodating unit 5 will now be described.

Figure 8:
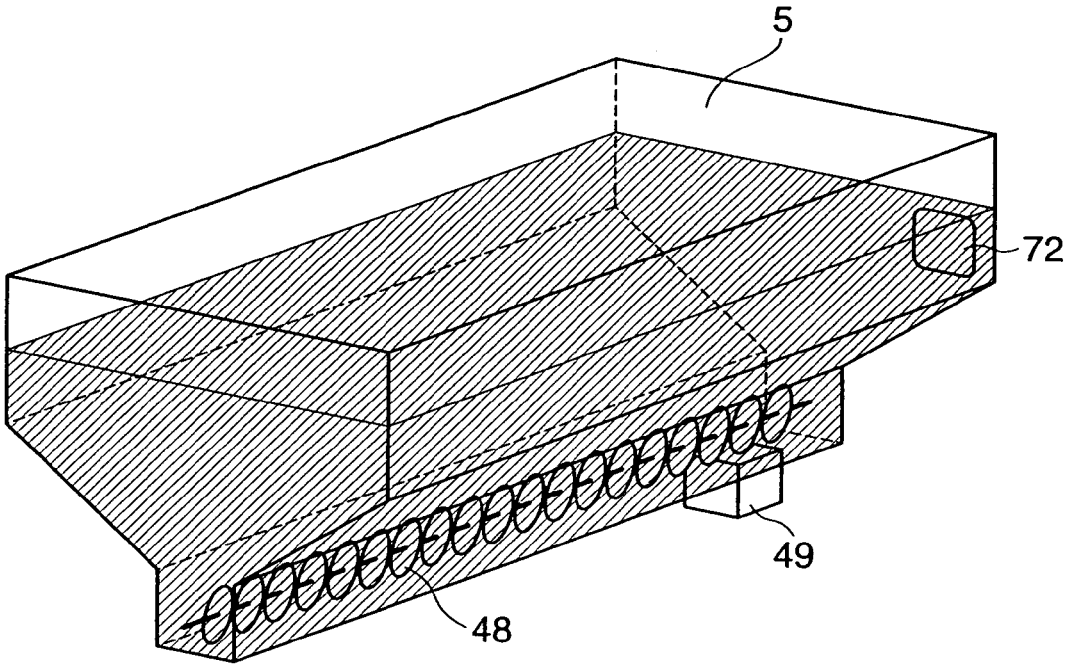
FIG. 8 is a perspective view illustrating a toner accommodating unit according to the present invention.

As shown in FIG. 8, the toner replenishing screw 48 is provided inside the toner accommodating unit 5. The amount of toner replenishment is controlled by the number of rpm's (rotating time). As mentioned earlier, the rotational speed (rpm) of the screw 48 is decided by the result of detection by the toner density sensor 46, and the process cartridge 7 is replenished with toner through an opening (not shown) in the toner accommodating unit 5.

Further, the toner accommodating unit 5 is provided with the memory means 72, the amount of toner remaining in the toner accommodating unit 5 is calculated depending upon information representing amount of use of the cartridge and the lifetime of the toner accommodating unit 5 is reported to the user.

There is no particular limitation regarding the memory means 72 used in the present invention so long as the memory means can store and hold signal information is rewritable fashion. For example, it is possible to use electrical memory means such as a RAM or a rewritable ROM, or magnetic storage means such as a magnetic recording medium, magnetic bubble memory or magneto-optic memory.

In this embodiment, a non-volatile memory is used as the memory means 72 inside the toner accommodating unit 5. A ferroelectric non-volatile memory (referred to as a "FeRAM" below) is a typical example. For instance, data sent from the CPU on the side of the main body is stored in the FeRAM using a reader/writer (not shown), and information within the FeRAM is sent to the CPU of the main body.

If the mechanism for detecting amount of toner remaining in the toner accommodating unit 5 basically is adapted so as to detect that the amount of remaining developer (toner) has fallen below a predetermined value, then the mechanism is not particularly limited and a well-known mechanism can be used. More specifically, it is possible to use a mechanism that detects the electrostatic capacitance of the toner, a mechanism for detecting toner weight and a mechanism that relies upon transmission of light.

In this embodiment, the rotational speed of the toner replenishing screw 48 shown in FIG. 8 is employed. The toner accommodating unit 5 has a filled capacity of 600 g and is capable of printing about 25,000 images (calculated in terms of size A4 and a printing ratio of 5%). Ordinarily, control is performed in such a manner that 300 mg of toner is supplied to the process cartridge 7 by rotation of the toner replenishing screw for 1 s. Thus, if the toner replenishing screw 48 is rotated for 2,000 s, the amount of toner remaining in the toner accommodating unit 5 will be zero.

If it is determined from the output of the toner density sensor 46 that toner density is low, then a signal is sent to the CPU in such a manner that toner replenishment is performed, as mentioned earlier. Upon receiving this signal, the CPU causes a motor (not shown), which is for driving the toner replenishing screw of the toner accommodating unit 5, to rotate, whereby the process cartridge 7 is replenished with toner from the toner accommodating unit 5. The arrangement is such that the CPU now writes data indicative of motor rotation time to the memory means (FeRAM) 72 of the toner accommodating unit 5 using the reader/writer for the toner accommodating unit 5.

Since the relationship between the screw rotation time and amount of toner used is linear, it is possible to sense the remaining amount of toner, namely the lifetime of the toner accommodating unit 5, constantly. The lifetime of the toner accommodating unit 5 is detected based upon the rpm's of the screw; if the remaining amount of toner has reached a predetermined amount, then a display indicating advance notice of absence of toner is presented. According to this embodiment, advance notice of absence of toner is displayed on a panel to so notify the user when the remaining amount of toner has reached 15%.

The final decision that amount of remaining toner is zero is rendered by the toner density sensor 46 of the process cartridge 7. FIG. 9 illustrates a change in the output value of the toner density sensor 46 when absence of toner is determined. If toner exists in the toner accommodating unit 5 in FIG. 9, the output value of the toner density sensor 46 will substantially agree with 2.5 V, which is the target value Vt (the "toner-present state" in FIG. 9). If there is no longer any toner in the toner accommodating unit 5, replenishment of toner will no longer be performed even if toner is consumed, and therefore the output value of the toner density sensor 46 gradually rises (the "no-toner state" in FIG. 9). This state is one in which although there is no toner in the toner accommodating unit 5, toner still remains in the developing device 4. The final no-toner decision is rendered when the output value attains the value of 3.2 V in FIG. 9, which serves as a no-toner decision value Vn. At this time a display is presented on the panel to notify the user that this state has been attained.

In this embodiment, the no-toner decision value Vn is a limit value in the no-toner state. That is, the value Vn indicates a state in which toner still exists in the developing device 4 but is about to become too small in quantity. The output value of the toner density sensor 46 is detected one printed sheet at a time and the no-toner decision is rendered when the output value of the toner density sensor 46 has exceeded the no-toner decision value Vn continuously for a plurality of sheets, in order to take statistical dispersion into consideration. In this embodiment, the no-toner decision is rendered if Vn is exceeded for three sheets in succession. It should be noted that the toner density at the output value of 3.2 V is 6%. This is a set level at which a substantially satisfactory image density is obtained.

In this embodiment, whether the no-toner state has been attained or not is determined upon associating toner density with voltage. If a graph (table) of the kind shown in FIG. 9 is prepared, therefore, control can be performed with ease. Since such a table can also be simply stored in the FeRAM or substituted for another, it will suffice to merely change the table when it is desired to change the control method. This is very convenient.

The toner density restoration sequence, which is a characterizing feature of the present invention, will now be described.

Figure 10:
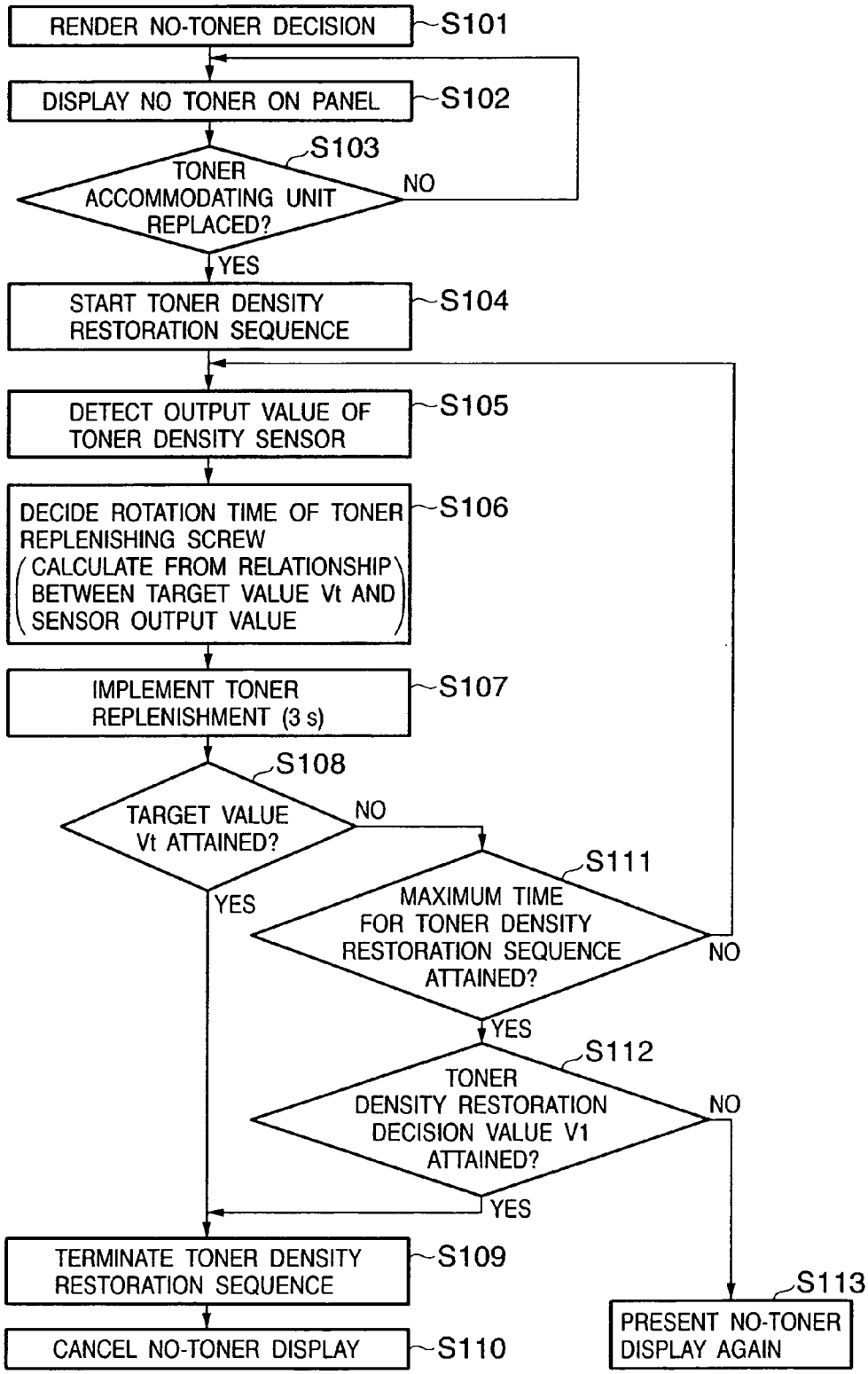
FIG. 10 is a flowchart illustrating a toner density restoration sequence according to a first embodiment of the present invention.

FIG. 10 is a flowchart for describing a toner density restoration sequence executed after a no-toner indication in the color laser printer of this embodiment.

First, after the no-toner decision is rendered at step S101, the image forming apparatus displays the no-toner indication on the panel to so notify the user at step S102. At this time the apparatus is halted as necessary and stops accepting prints.

Next, at step S103, the image forming apparatus determines whether the user has replaced the toner accommodating unit 5. More specifically, the main body of the image forming apparatus is provided with a sensor for judging extraction and insertion of the toner accommodating unit 5. Whether the toner accommodating unit 5 has been replaced or not is determined based upon what has been sensed by this sensor. The replacement determination may be made by sensing that the front door of the apparatus has been opened and closed, for example, and it is possible to change the method of determination appropriately.

If replacement has been determined, then the toner density restoration sequence is started at step S104. If the toner accommodating unit 5 has not been replaced, then the no-toner display continues to be presented. Next, at step S105, the output value of the toner density sensor 46 is read out and control proceeds to step S106. Here the rotation time of the toner replenishing screw 48 is decided in accordance with this output value. Toner replenishment then begins at step S107.

In this embodiment, the toner replenishment operation is performed in such a manner that the read-out of the output value from toner density sensor 46 and toner replenishment conforming to this output value are repeated in cycles of 3 s each. The screws 43, 44 in the developing device 4 are being rotated at this time. The circulation of the developer inside the developing device 4 is such that one full circuit is achieved in 30 s. That is, the developer is circulated by causing the screws 43, 44 to rotate for 30 s. The amount of toner replenishment is decided by the relationship between the output value of sensor 46 and the amount of developer that advances in 3 s. For example, if the output value of the sensor 46 is 3.2 V, then the toner density is 6%. Toner in an amount that will provide the desired toner density of 8% with respect to the developer that advances in 3 s is supplied for replenishment. In other words, approximately 0.4 g of toner corresponding to 2% is supplied with respect to 20 g of developer, which is 3/30 of the total amount of developer of 200 g.

Since the circulation of the developer inside the developing device 4 is such that one full circuit is achieved in 30 s, the developer that has been replenished with toner at the toner replenishing port 47 is rotated and circulated by the screws 43, 44 and it takes 30 s for the developer to arrive at the toner density sensor 46 after one full circuit. Accordingly, if toner replenishment from the newly installed toner accommodating unit 5 has been performed properly from the start, the desired toner density will be attained by a toner density restoration sequence lasting about 30 s.

It should be noted that the time for causing the developer to circulate depends upon the structure of the developing device and is set in order that an appropriate amount of replenished toner will be supplied to the developing section. Accordingly, if the structure of the developing device is changed, then the length of time also is be changed suitably.

Next, at step S108, it is determined whether the target value Vt has been attained (whether the voltage has fallen to Vt). If it has been attained, control proceeds to step S109 and the toner density restoration sequence ends. The no-toner display is cancelled at step S110.

If it is found at step S108 that the target output has not been attained, then control proceeds to step S111, at which it is determined whether a predetermined maximum time for the toner density restoration sequence has been attained. In this embodiment, this time is set to 60 s, which is short enough to avoid user inconvenience. If this time has not been attained, then control proceeds to step S105 again and toner replenishment is repeated (S105 to S107).

If it is found at step S108 that the target output has been attained, then the toner density restoration sequence ends (S109, S110).

A case where the maximum time for the toner density restoration sequence is attained (S111) when it is found at step S108 that the target value Vt has not been attained will be described. Following this it is determined whether a decision value V1 (an intermediate target value) concerning toner density restoration has been attained. Specifically, a value between the target value Vt and the no-toner decision value Vn is decided as the toner density restoration decision value. The decision value is 3.0 V in this embodiment. This value is one that can be attained following the maximum toner restoration sequence time of 60 s even in a case where toner replenishment is no longer performed properly when a normal toner accommodating unit 5 has been left standing with its toner replenishing screw facing upward. Moreover, it is a value that cannot be attained if a toner accommodating unit 5 devoid of toner has been installed. Accordingly, if the toner accommodating unit 5 is normal and contains toner, the toner density restoration decision value will be attained, the toner density restoration sequence will be terminated and the no-toner display will be cancelled (S109 to S110).

Since the sensor output value has not attained the target value Vt at this time, the toner density has not attained the target of 8%. In actuality, however, toner density gradually recovers during the subsequent printing operation. Accordingly, absolutely no problems actually arise in terms of the image and an excellent image is obtained.

Further, if the user has installed a toner accommodating unit that is devoid of toner or one that has malfunctioned, an abnormality with the toner accommodating unit can be determined through this process and the no-toner display can be presented again, thereby making it possible to inform the user of the abnormality.

By executing the above-described toner density restoration sequence, the no-toner indication is cancelled in the minimum time of 30 s if a toner accommodating unit having a sufficient amount of replenished toner has been installed normally from the start. This means that the user need not wait unnecessarily for cancellation of the no-toner indication.

Next, the no-toner indication is cancelled in 60 s even in a case where the toner accommodating unit 5 that has been installed is normal but contains only a small amount of replenished toner because it has been left standing. According to the present invention, it is possible to achieve such cancellation very early by providing the toner density restoration decision value V1 anew and setting the upper-limit time on the toner density restoration sequence time to the minimum value.

Furthermore, according to the present invention, even if the toner accommodating unit that has been installed is devoid of toner or has malfunctioned, this can be reported to the user in 60 s, which is short enough to avoid user inconvenience.

If the toner density restoration decision value V1 is not provided, as is the case with the prior art, then, when the toner accommodating unit that has been installed is normal but contains only a small amount of replenished toner because it has been left standing, it will be necessary to continue the toner density restoration sequence until perfect agreement with the target density is achieved. Conventionally, the time required is far longer than 60 s. A further inconvenience is that even though the toner accommodating unit that has been installed is devoid of toner or has malfunctioned, the user will learn of the abnormality only after the execution of a very lengthy toner density restoration sequence.

According to the present invention, it is possible to provide an image forming apparatus, a process cartridge and a toner accommodating unit that are extremely advantageous for the user.

If toner replenishment from the toner accommodating unit has been performed satisfactorily, the no-toner indication can be cancelled very early. Conversely, if there has been too little toner replenishment from the toner accommodating unit, the no-toner indication can be cancelled without taking more time than necessary. In addition, if a toner accommodating unit that is devoid of toner or that has malfunctioned has been installed, the status of the toner accommodating unit can be reported to the user earlier. As a result, it is possible to complete the toner density restoration sequence at the time of replacement of a toner accommodating unit without the user being inconvenienced by being forced to wait longer than necessary.

<Second Embodiment>

In the first embodiment, in which toner replenishment is performed at the time of the toner density restoration sequence, toner replenishment is carried out so as to attain a target value. By contrast, in a second embodiment, a second target value V2, which is slightly greater than the above-mentioned target value (meaning that the toner density will be slightly lower) is set and toner replenishment is carried out with regard to the value V2.

This will be described with reference to FIG. 11, which is a flowchart for describing a toner density restoration sequence executed after a no-toner indication in the color laser printer of this embodiment.

This embodiment differs from the first embodiment in regard to the setting of rotation time of the toner replenishing screw at step S106 in FIG. 10, namely in that the rotation time of the toner replenishing screw is decided not with respect to the target value Vt but with respect to the second target value V2, which is slighter larger. In other words, the processing of step S206 is executed instead of the processing of step S106.

Figure 11:
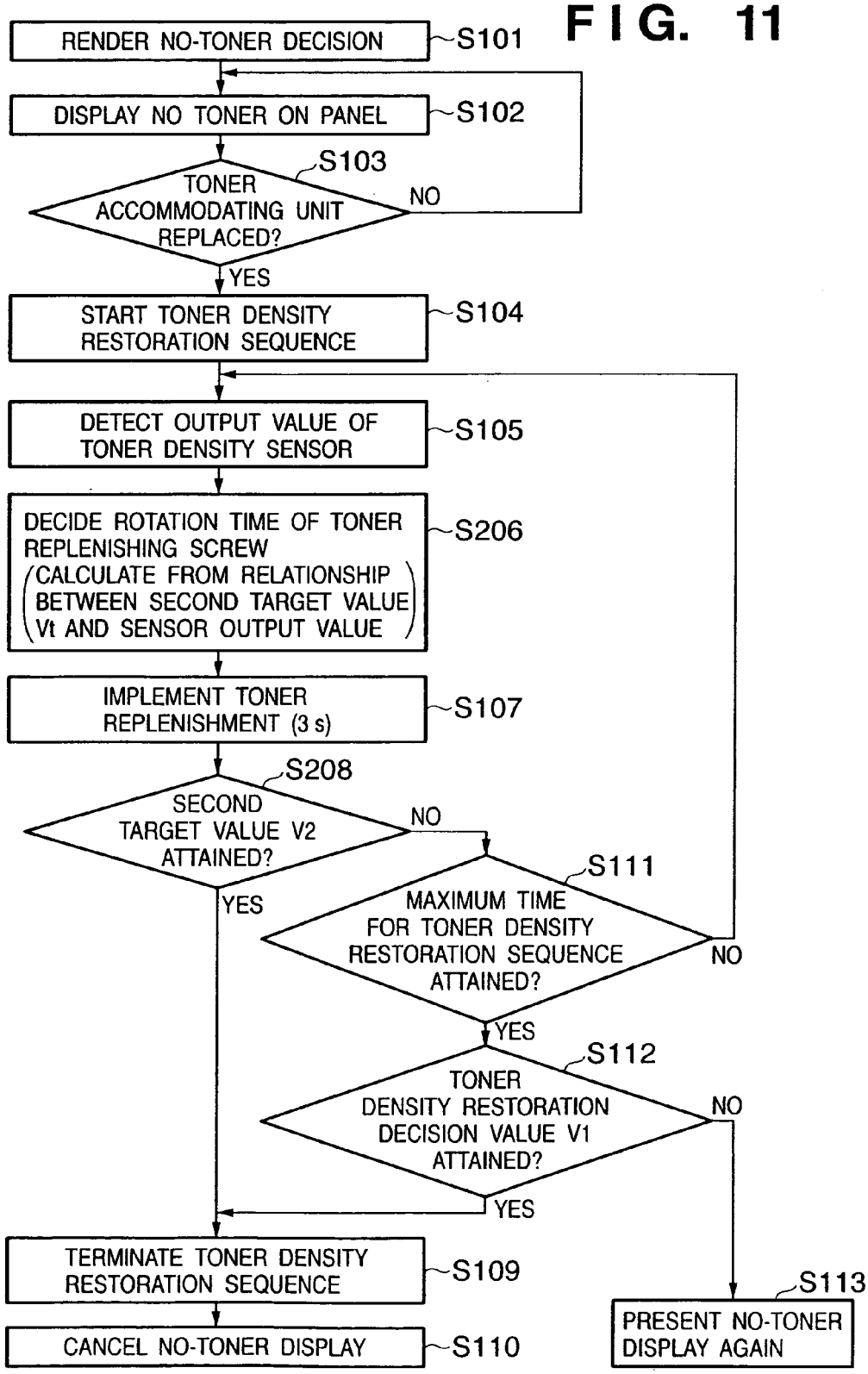
FIG. 11 is a flowchart illustrating a toner density restoration sequence according to a second embodiment of the present invention.

Another difference is that step S208 in FIG. 11 is executed instead of step S108 in FIG. 10. Step S208 is processing for setting the second target value V2 (a first intermediate target value), which is slightly greater than the target value Vt. Furthermore, the second target value V2 is set to a value lower than the toner density restoration decision value V1 (a second intermediate target value) described in the first embodiment. Other processing steps are the same as those of the first embodiment, are designated by like step numbers and need not be described again.

In this embodiment, the second target value V2 is made 2.7 V. This is greater than the target value Vt of 2.5 V and less than the toner density restoration decision value V1 of 3.0 V.

In the case of the first embodiment, toner replenishment is performed abruptly when the toner density restoration sequence is executed and therefore toner tribo-electrification may tend to become unstable when the toner density corresponding to the target value is attained. By contrast, by adopting the settings of the second embodiment, the second target value is set to a value greater than the above-mentioned target value and abrupt toner replenishment is mitigated.

In the case of the first embodiment, the target value is 2.5 V. This is the usual target value of toner density at the time of image formation. When the toner cartridge is replaced, there is a recovery from the toner-density detection value 3.2 V in the no-toner state to the target value of 2.5 V and therefore an operation for replenishing toner rapidly is performed commensurate with the difference between the target value and the detected value. When toner is replenished abruptly, tribo-electrification of the toner in the developing device becomes unstable. Consequently, when an image forming operation is executed subsequently, image density tends to fluctuate. According to this embodiment, the desired value is changed over to a value larger than the target value (a lower value of toner density) if the toner cartridge has been replaced, thereby preventing toner from being replenished abruptly.

As a result, in accordance with the second embodiment, toner tribo-electrification can be prevented from becoming unstable when the toner density restoration sequence is executed, and when printing is performed subsequently, it is easier to prevent changes in image density and the occurrence of fogging owing to a fluctuation developing properties.

Further, if toner replenishment from the toner accommodating unit has been performed satisfactorily, the no-toner indication can be cancelled very early. Conversely, if there has been too little toner replenishment from the toner accommodating unit, the no-toner indication can be cancelled without taking more time than necessary. In addition, if a toner accommodating unit that is devoid of toner or that has malfunctioned has been installed, the status of the toner accommodating unit can be reported to the user earlier. As a result, it is possible to complete the toner density restoration sequence at the time of replacement of a toner accommodating unit without the user being inconvenienced by being forced to wait longer than necessary.

Furthermore, the first toner density restoration decision value (first intermediate target value) is provided between the above-mentioned target value and the second toner density restoration decision value (second intermediate target value) for the purpose of preventing the toner tribo-electrification from readily becoming unstable when toner replenishment is performed to attain a toner density that corresponds to the prescribed target value at execution of the toner density restoration sequence. As a result, a decline in toner tribo-electrification can be prevented after the toner density restoration sequence and it is easier to prevent changes in image density and the occurrence of fogging owing to a fluctuation developing properties.

In addition, the output value of 2.5 V as a target output value of the toner density sensor, explained in the first and second embodiments, is a predetermined value that the toner density is determined to become 8%. The output value of 2.5 V is stored in a memory such as a non-volatile memory (not shown) of the image forming apparatus.

The foregoing is a description of the first and second embodiments. According to the present invention, however, it is possible to select specific ones of the non-magnetic toner and magnetic carrier of the two-component developer and combine these with the first and second embodiments to obtain even greater effects from the present invention.

In the present invention, spherical toner, especially a polymeric toner, is preferred as the toner that is one of the components of the developer. However, spherical toner will suffice even if it is not a polymeric toner, and spherical toner obtained by another method also may be used.

A polymeric toner that can be used ideally in the present invention is one produced by adding colorant and a charge control agent to a resin monomer, suspending this resin monomer composition in an aqueous medium and causing polymerization. The method of manufacture is ideal for manufacturing a polymeric toner inexpensively. The polymerization method is not limited to the above-mentioned suspension polymerization method. For example, the toner may be produced by an emulsion polymerization method and other additives may be included.

The polymeric toner obtained by the above-described suspension polymerization has a shape coefficient SF-1 of 100 to 140 and a shape coefficient SF-2 of 100 to 120. The shape coefficients SF-1 and SF-2 are defined as values obtained by performing a random sampling of 100 toner particles using an FE-SEM (S-800) manufactured by Hitachi, Ltd., introducing image information obtained from these toner particles to an image analyzer (Lusex 3), which is manufactured by Nicolet, via an interface to thereby analyze the image, and performing a calculation based upon the following equations:

$$SF\text{-}1=[(\mathrm{MXLNG})2/\mathrm{AREA}]\times(\pi/4)\times 100$$

$$SF\text{-}2=[(\mathrm{PERI})2/\mathrm{AREA}]\times(4/\pi)\times 100$$

where AREA represents the toner projection area, MXLNG the absolute maximum length and PERI the perimeter.

The shape coefficient SF-1 indicates the degree of toner sphericity. As the value of this coefficient rises, the toner particle gradually becomes less spherical and more irregular in shape. The shape coefficient SF-2 indicates the degree of unevenness of the toner surface. As the value of this coefficient rises, surface unevenness becomes more pronounced.

In view of the fact that conventional ground toner has shape coefficients SF-1 and SF-2 of 180 to 220 and 180 to 200, respectively, it will be understood that polymeric toner has a shape much closer to a true sphere in comparison with such ground toner. If shape of toner approximates a sphere, there are fewer factors to cause a change in shape and such a change in shape does not readily occur. Furthermore, whereas ground toner exhibits a major variance in particle shape and large variations in void ratio and bulk density in laminar toner, the fact that polymeric toner is spherical means that bulk density is stable and changes little. In addition, the detection signal from an inductance sensor when developer has been left standing contains little error.

Accordingly, if polymeric toner is used as a toner mixed with a two-component developer, an error in the detection signal from a toner density sensor can be suppressed and it is possible to perform toner density control having less error in comparison with that when a ground toner is used. The determination of absence of toner and the determination of toner density restoration can be performed more precisely.

In the present invention, a spherical carrier is preferred also with regard to the magnetic carrier that is the other component of the two-component developer, and a high carrier resistance also is preferred, namely a volume resistivity of $1\times10^{10}$ to $1\times10^{14}$ Ω cm. In one example, the inventors have produced a high-resistance spherical carrier in the form of a resin magnetic carrier from a binder resin, magnetic metal oxide and non-magnetic metal oxide by a polymerization method. If resistance can be adjusted and a spherical shape obtained, other methods of manufacture may used.

In accordance with the high-resistance carrier, a change in bulk density is reduced by adopting a spherical shape. By achieving a high resistance, electric charge that accumulated in the carrier is not readily released and a fluctuation in electric charge in the carrier when the developer has been left standing is reduced. As a result, this carrier is suited to an object that is to undergo inductance-type toner density control. If a high-resistance spherical carrier is combined with the toner replenishment mechanism described in the first embodiment, it is possible to greatly reduce error in toner density control.

In addition to the above, it goes without saying that the structure of the image forming apparatus and control system can be modified and changed in various way as necessary.

<Other Embodiments>

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application Nos. 2003-203288 filed on Jul. 29, 2003 and 2004-214852 filed on Jul. 22, 2004, which are hereby incorporated by references herein.

What is claimed is:

1. An image forming apparatus in which a toner accommodating unit for accommodating toner is removably installed, comprising:

a developing unit for developing a latent image on an image carrier using a developer that includes toner and carrier;

a toner density sensor for sensing toner density of the developer in said developing unit; and a controller for detecting replacement of said toner accommodating unit and executing a toner density restoration sequence for restoring toner density in said developing unit if it has been determined that there is no toner in said toner accommodating unit based upon a detection value from said toner density sensor;

wherein said controller controls operation of the toner density restoration sequence based upon a predetermined target value relating to toner density restoration and a toner density restoration decision value that is different from said predetermined target value.

2. The apparatus according to claim 1, wherein said controller executes the toner density restoration sequence for a predetermined period of time and determines whether the detection value has attained the toner density restoration decision value upon elapse of the predetermined period of time.

3. The apparatus according to claim 1, wherein said controller halts the toner density restoration sequence if the detection value has attained the toner density restoration decision value even in a case where the detection value has not attained the predetermined target value upon elapse of the predetermined period of time.

4. The apparatus according to claim 2, wherein said controller outputs an alert signal if the detection value has not attained the toner density restoration decision value upon elapse of the prescribed period of time.

5. A method of controlling an image forming apparatus in which a toner accommodating unit for accommodating toner is removably installed, comprising:

a toner density detecting step of detecting toner density of a developer in a developing unit that develops a latent image on an image carrier using the developer, which includes toner and carrier;

a determination step of determining whether the toner accommodating unit has toner based upon a detection value from said toner density detecting step;

a sequence execution step of detecting replacement of the toner accommodating unit and executing a toner density restoration sequence for restoring toner density in the developing unit if it has been determined at said determination step that there is no toner in the toner accommodating unit; and a control step of controlling operation of the toner density restoration sequence based upon a predetermined target value relating to toner density restoration and a toner density restoration decision value that is different from said predetermined target value.

6. The method according to claim 5, wherein, at said control step, the toner density restoration sequence is executed for a predetermined period of time and whether the detection value has attained the toner density restoration decision value is determined upon elapse of the predetermined period of time.

7. The method according to claim 5, wherein, at said control step, the toner density restoration sequence is halted if the detection value has attained the toner density restoration decision value even in a case where the detection value has not attained the predetermined target value upon elapse of the predetermined period of time.

8. The method according to claim 6, wherein an alert signal is output if the detection value has not attained the toner density restoration decision value upon elapse of the prescribed period of time.

9. An image forming apparatus in which a toner accommodating unit for accommodating toner is removably installed, comprising:

a developing unit for performing image formation;

a density sensor for sensing density of toner in said developing unit; and a controller for executing an operation for replenishing toner from the toner accommodating unit based upon an output value from said density sensor and a predetermined density reference value;

wherein if the toner accommodating unit has been replaced, said controller executes an operation for changing over the predetermined density reference value and replenishing said developing unit with toner.

10. The apparatus according to claim 9, wherein said controller executes an operation for replenishing said developing unit with toner from the toner accommodating unit based upon the output value from said density sensor and the predetermined density reference value during image formation;

and if the toner accommodating unit has been replaced, said controller executes an operation for replenishing said developing unit with toner from the toner accommodating unit based upon the output value from said density sensor and a reference value different from the predetermined density reference value.

11. The apparatus according to claim 9, wherein if the toner accommodating unit has been replaced, said controller executes the operation for replenishing toner based upon the output value from said density sensor, the predetermined density reference value and a predetermined toner density restoration decision value.

12. A method of controlling an image forming apparatus in which a toner accommodating unit for accommodating toner is removably installed, comprising:

a sensing step of sensing density of toner in a developing unit for performing image formation; and a toner replenishing step of replenishing toner from the toner accommodating unit based upon a sensed toner density value and a predetermined density reference value; and a toner density restoration step of executing an operation for changing over the predetermined density reference value and replenishing the developing unit with toner if the toner accommodating unit has been replaced.

13. The method according to claim 12, wherein said toner replenishing step replenishes the developing unit with toner from the toner accommodating unit based upon the output value from the density sensor and the predetermined density reference value during image formation; and said toner density restoration step replenishes the developing unit with toner from the toner accommodating unit based upon the output value from the density sensor and a reference value different from the predetermined density reference value.

14. The method according to claim 11, further comprising a control step of controlling the operation for replenishing toner based upon the output value from the density sensor, the predetermined density reference value and a predetermined toner density restoration decision value if the toner accommodating unit has been replaced.

* * * * *